United States Patent [19]

Barnett

[11] 4,431,907

[45] Feb. 14, 1984

[54] RANGE TEMPERATURE PROTECTION

[75] Inventor: Eugene J. Barnett, Mansfield, Ohio

[73] Assignee: White Consolidated Industries, Inc., Cleveland, Ohio

[21] Appl. No.: 312,097

[22] Filed: Oct. 16, 1981

[51] Int. Cl.[3] ..... H05B 3/68

[52] U.S. Cl. ..... 219/449; 219/413; 219/452; 219/512; 219/446; 337/343

[58] Field of Search ..... 219/412, 413, 448, 446, 219/449, 450, 452, 453, 512, 522; 337/343

[56] References Cited

U.S. PATENT DOCUMENTS

| | | | |
|---|---|---|---|
| 2,392,635 | 1/1946 | Bletz | 219/449 X |
| 2,399,423 | 4/1946 | Bletz | 219/452 |
| 2,409,414 | 10/1946 | Bletz | 219/446 |
| 2,861,151 | 11/1958 | Moore | 337/343 |
| 2,866,881 | 12/1958 | McMillen | 219/522 |
| 3,612,826 | 10/1971 | Deaton | 219/453 |
| 3,899,656 | 8/1975 | Smith | 219/413 |
| 3,912,904 | 10/1975 | Phifer | 219/413 |

OTHER PUBLICATIONS

Frigidaire, Tech-Talk Manual, vol. 73, No. 9, pp. R-24 and R-25.

Frigidaire, Tech-Talk Manual, vol. 74, No. 6, p. R-20.

Frigidaire, Tech-Tips Manual, Issue No. 209, p. R-8, Apr. 1979.

*Primary Examiner*—Volodymyr Y. Mayewsky

*Attorney, Agent, or Firm*—Pearne, Gordon, Sessions, McCoy, Granger & Tilberry

[57] ABSTRACT

A domestic range of the electric type includes a cooking platform providing a plurality of "burner" locations constituted by pancake-shaped surface heating elements formed of spirally wound resistance wire. An elongated boxlike control unit extends upwardly from and across the back edge of the cooking platform. An oven chamber of the pyrolytic self-cleaning type is located below the range platform and includes radiant-type heating elements also formed of resistance wire. A heat-sink-mounted electronic module located within the control unit is protected from damaging high temperatures caused by improper operation of the range by a pair of normally closed temperature-sensitive bimetal actuated switches mounted to the module heat sink, the switches being connected in electrical series relationship between the heating elements and their electrical power source.

4 Claims, 5 Drawing Figures

RANGE TEMPERATURE PROTECTION

BACKGROUND OF THE INVENTION

The invention relates in general to thermostatic controls, and in particular to means for protecting a temperature-sensitive electronic module associated with a domestic range employing electric resistance heating elements.

The continuing advance of microelectronics has made possible the computerized control of domestic appliances such as programmable microwave cooking ovens, automatic dishwashers, domestic ranges and the like. The associated integrated circuit containing electronic module for accomplishing such computerized microelectric control, while continuing to decrease in cost, still constitutes a high cost component of the controlled appliance, and thus must be fully protected from damaging high temperature conditions.

The problem of module temperature control is especially acute in a microcomputer-controlled domestic range having a horizontal cooking platform providing a plurality of resistance wire surface heating elements and a pyrolytic type self-cleaning oven located below the platform, the oven including radiant heating elements also formed of resistance wire.

In such a range, the electronic control module is typically contained within a boxlike control unit extending upwardly from and across the back edge of the cooking platform. Where the range is located in a confined area, it may be possible to overheat the module-containing control unit during a high-temperature self-cleaning cycle of the oven and/or during improper usage of surface heating units in an unloaded condition (i.e., without a cooking utensil placed on the energized surface heating element).

To protect the electronic module from damage by high temperatures, means must be provided to limit to a tolerable level an over-temperature condition of the module caused by the energization of one or more of the heating elements. Such a temperature limiting means must be durable and very reliable, due to the relatively long life expectancy of domestic appliances. Also, such a means must be low in cost due to the competitive nature of the domestic appliance business.

SUMMARY OF THE INVENTION

The present invention provides, in a domestic range having heating means temperature-regulated by a control unit including an electronic control module, an over-temperature protection means for the control module. The protection means includes a temperature-sensitive switch located generally at the site of the control module. The switch disables at least a portion of the heating means at a predetermined sensed temperature to preclude damage to the module caused by high temperatures generated by the heating means.

Preferably, the switch is constituted by a pair of bimetal snap-disc-actuated switches straddling the module, the bimetal switches and the module being mounted to a common heat sink member. The bimetal switches automatically reset when the sensed temperature reaches a tolerable level wherein normal operation of the range is resumed.

A fuller understanding of the invention may be had by referring to the following description and claims, taken in conjunction with the accompanying drawing.

DETAILED DESCRIPTION OF THE PREFERRED EMBODIMENTS

Figure 1:
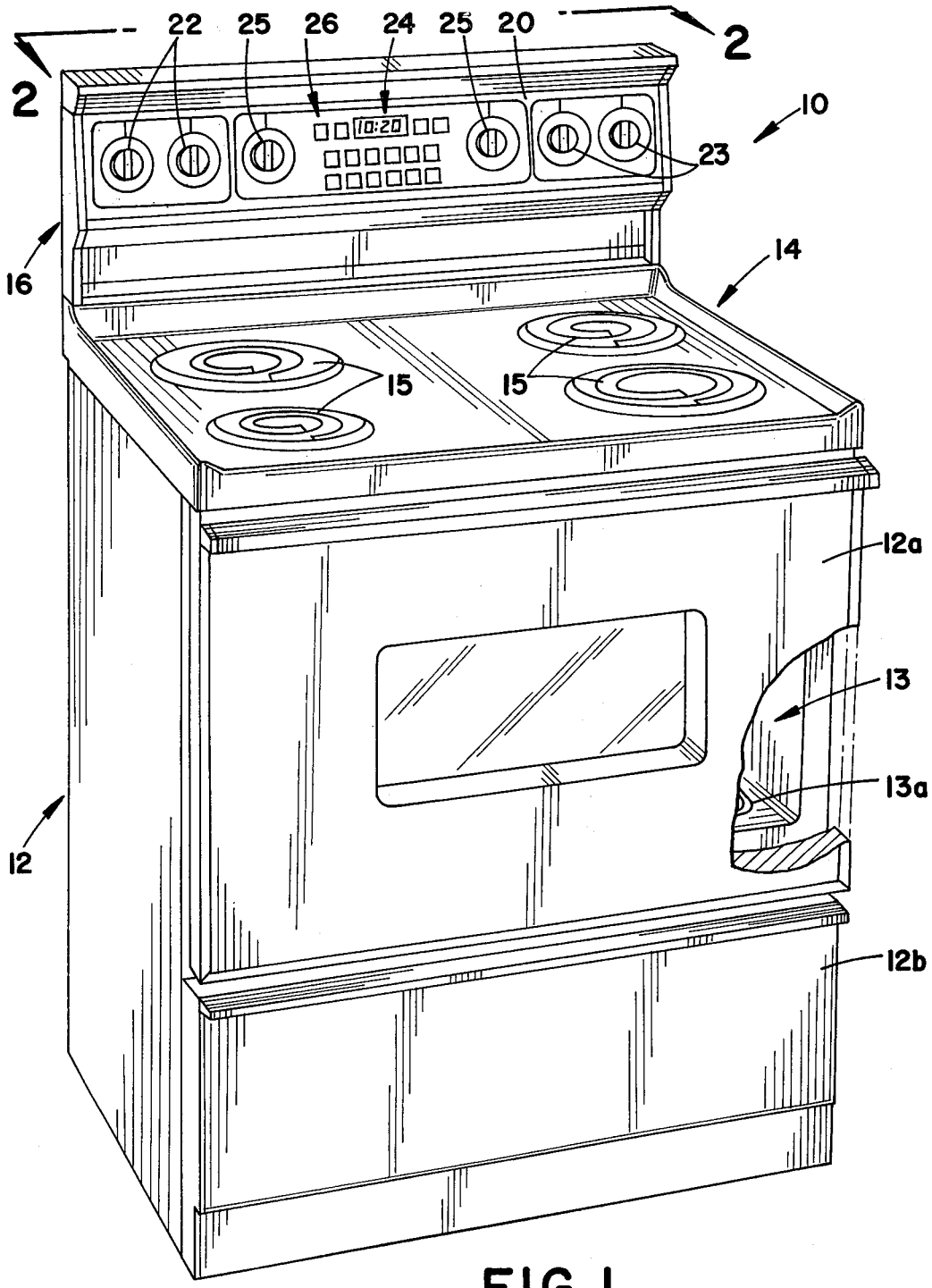
FIG. 1 is a perspective view of a domestic range of the electric type incorporating the present invention, the range including an electronic module containing control unit extending upwardly from and across the back of the top horizontal cooking platform of the range.

With reference to FIG. 1, there is illustrated in accordance with the present invention a freestanding domestic range 10 of the electric type. The range includes a lower boxlike oven housing 12 typically formed of sheet metal panels. The housing 12 includes a windowed oven door 12A and a conventional utensil drawer 12B. The oven door 12A can be opened to pivot downwardly about a lower horizontal axis to provide access to an oven chamber 13, including an oven heating bake element 13A and one or more broiling elements (not shown). The element 13A and the non-illustrated broil elements are formed of shielded resistance wire that heats to a high degree when a predetermined amount of current flows through it. The oven chamber 13 can thus be highly heated by the heating elements contained therein so as to cause pyrolytic cleaning action of the oven walls, the oven door 12A being locked in a closed position during such pyrolytic cleaning, as is well known in the art.

A horizontal cooking platform 14 comprises the top of the boxlike oven housing 12, the horizontal cooking platform 14 including a plurality (e.g., four) of resistance wire surface heating elements 15 constituting burner locations upon which cooking utensils are placed for heating. The surface heating elements 15 are of a conventional nature and take the form of a pancake-shaped element of shielded resistance wire spirally wound as illustrated.

Extending across the back and upwardly from the horizontal cooking platform 14 is a control unit 16. The control unit 16 is boxlike and includes a front panel 20 providing, for example, six apertures through which extend the control shafts carrying four burner control knobs 22, 23 and two oven control knobs 25. The control panel 20 is typically formed of opaque glass and carries numerous indicia associated with the manual control knobs 22, 23, 25 to permit the user to regulate the temperature of the surface heating elements 15 and the temperature of the oven chamber 13. Located generally at the center or intermediate portion of the glass front panel 20 is a transparent window area 24 through which a time display mounted rearwardly of the panel 20 within the control unit 16 can be observed. To either side and below the display 24 is a plurality of touch pads 26 of the well-known capacitive switch type carried on the surface of the glass panel 20. The touch pads 26 are used to program an electronic control module to be subsequently illustrated and discussed, the module providing for the computerized time control of the oven chamber 13, the window area 24 being used to visually feed back to the user programmed information inputted via the touch pads 26, as well as conventional time of day information. While the control unit 16 illustrated in FIG. 1 only provides for computerized turning on and turning off of the oven chamber 13 (with temperature control of the oven chamber 13 being conventionally provided via the oven control knobs 25), it is to be recognized that a nonapertured glass panel 20, including touch pads or equivalents in place of the knobs 22, 23, 25, could be provided so as to provide full electronic touch control for the surface heating elements 15 and all oven heating elements.

If one or more of the surface heating elements 15 are energized to a high power condition, without a cooking utensil in place on the respective elements, heat radiated by the elements will impinge on the control unit 16 and, in particular, on the generally opaque glass front panel 20. Such a condition could cause the control unit 16 to be highly heated, wherein components within the control unit 16 would also be heated to a high extent. Further, pyrolytic cleaning of the oven chamber 13 at a temperature range of about 950° F. for a time period of, for example, two or more hours could cause the entire oven housing 12 to heat up as well as the control unit 16, thereby exposing the components within the control unit 16 to a high temperature condition. The temperature problem noted above becomes particularly acute if the range 10 is located in a confined area wherein only a limited amount of cooling air can be circulated by convection through and about the domestic range 10.

Figure 2:
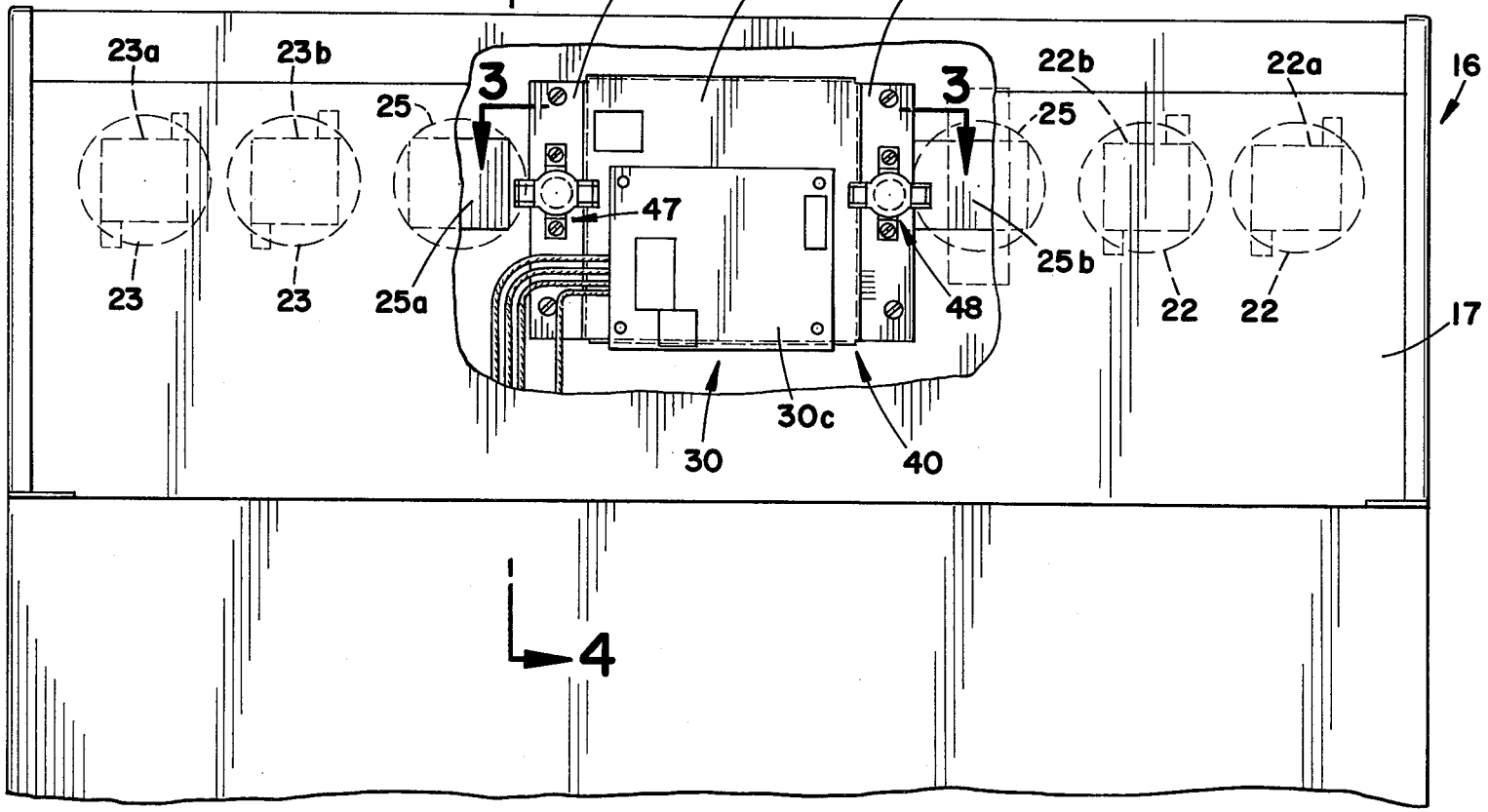
FIG. 2 is a rearward view, with portions cut away, of the control unit illustrated in FIG. 1.

With reference to FIG. 2, there is illustrated a rearward view of the control unit 16 with the burner control knobs 22, 23 (and associated electric power control elements 22*a*, 22*b*, 23*a*, 23*b*) being illustrated in phantom along with the oven control knobs 25 (and associated electric power control elements 25*a*, 25*b*). The rear of the control unit 16 is normally closed by a back panel or cover 17. In FIG. 2, a central portion of the back panel of the cover 17 has been cut away to reveal an electronic control module 30 which includes a power supply circuit board 30*c* (and other module boards to be subsequently illustrated) mounted on one side of a heat sink 40 in the form of a platelike metal bracket 42 having first and second side flanges 44, 46 fastened to an interior frame portion (to be subsequently illustrated) of the control unit 16. The control module 30 includes a plurality of temperature-sensitive, integrated circuit packages (e.g., a microprocessor, read-only-memory, etc.) of a known type which allow a range user to enter programmed material via the touch pad 26 (see FIG. 1) so as to determine when the oven chamber 13 (FIG. 1) will be heated on a time cycle basis.

To protect the module 30 from a damaging over-temperature condition, a temperature-sensitive switch means is located generally at the site of the control module. The switch means disables at least a portion of the range heating means (comprised of the oven heating element and surface heating element) at a predetermined sensed temperature to preclude damage to the module 30 caused by high temperature generated by the heating means of the range 10 (FIG. 1).

In a preferred form, the temperature-sensitive switch means is comprised of a pair of normally closed, bimetal snap disc thermostatic switches 47, 48 of a known type manufactured by Therm-O-Disc Incorporated of Mansfield, Ohio. The type of bimetal snap disc switch illustrated in FIG. 2 is of the general type shown in U.S. Pat. No. 2,954,447. However, the switch illustrated in the U.S. Pat. No. 2,945,447 patent is slightly more complex than the switches 47, 48 utilized in the preferred embodiment of the present invention. The bimetal snap disc switches 47, 48 have an open end exposing their respective snap discs. The open ends of the switches 47, 48 are fastened to and closed by a portion of the heat sink flanges 44, 46, wherein heating of the flanges of the heat sink 42 in turn causes generally radiant heating of the bimetal snap disc located within the switches 47, 48. Each switch 47, 48 is in series with a portion of the heating means of the range (surface and oven heating elements), wherein one or both of the switches 47, 48 can switch to an open condition to disable heating of the associated heating elements so as to maintain or lower the temperature of the module 30 to preclude its being damaged. The thermostatic switches 47, 48 will automatically reset to their normally closed electrically conducting condition to enable the disabled heating means portion upon a decrease from a predetermined temperature.

Figure 3:
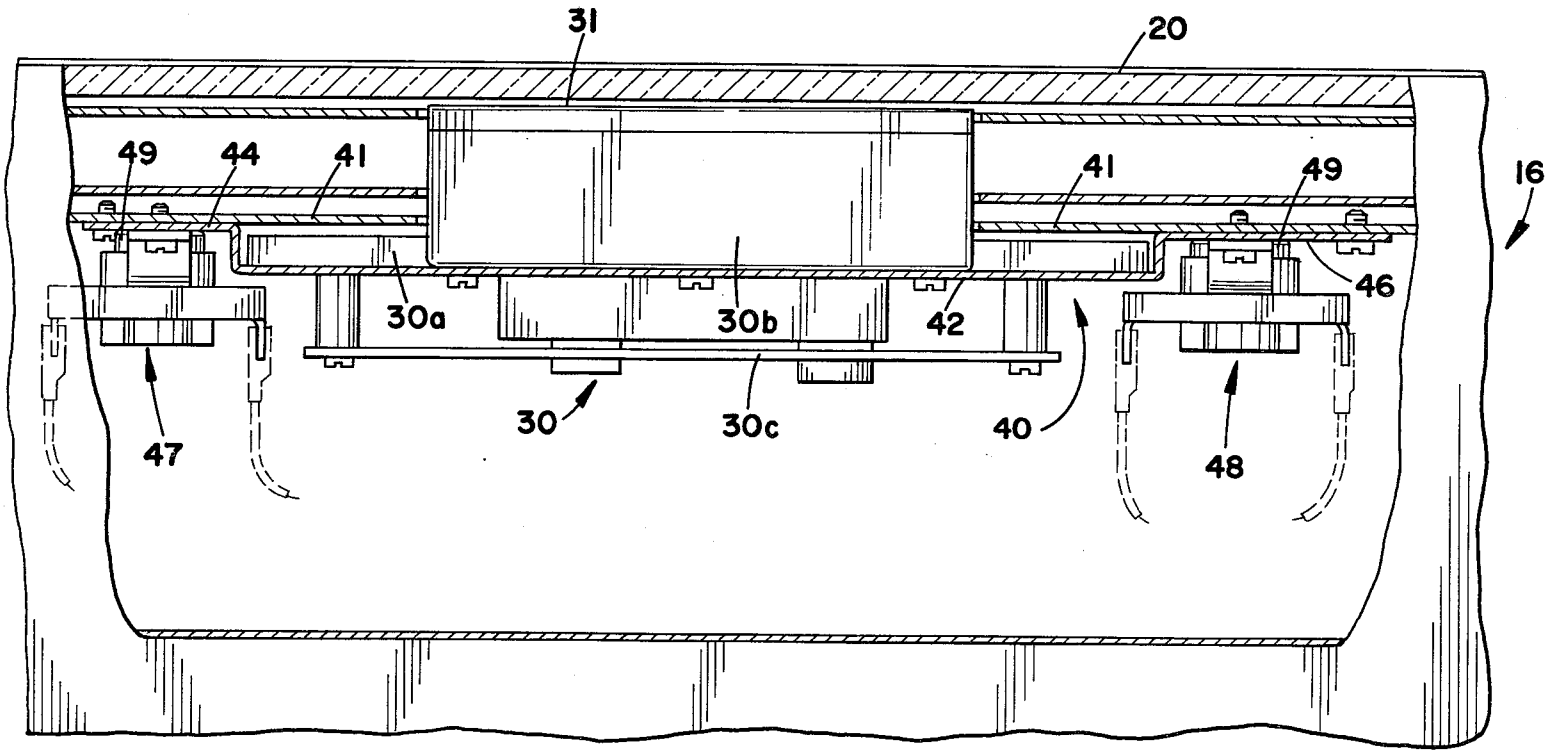
FIG. 3 is a plan view, with portions cut away, of the control unit illustrated in FIG. 2 as taken along line 3—3 of FIG. 4.

With reference to FIG. 3, the control module 30 is further illustrated as including a logic control circuit board 30*a* and a digital-type timer display circuit board 30*b* in addition to the power supply circuit board 30*c*. The integrated circuit containing boards 30*a*, 30*b*, 30*c* constitute the electronic control module 30, the boards 30*a*, 30*b*, 30*c* being fastened in position on the heat sink 40 (FIG. 2) having its flange portion 44, 46 fastened to an internal frame member 41 of the control unit 16. A display face 31 of the timer board 30*b* can be observed by the user through the transparent window area 24 (see FIG. 1) of the glass front panel 20, the timer display face 31 being spaced slightly inwardly away from the inner surface of the glass panel 20 to preclude conduction heating of the display face 31 by the panel 20.

The bimetal snap disc switches 47,48 are more clearly illustrated in FIG. 3 as having open-ended nose portions 49 in contiguous relationship against the heat sink flanges 44, 46, the portions 49 of the switches containing the bimetallic discs which are directly exposed to radiant heating by the flanges 44, 46. In a preferred manner, the switches 47, 48 straddle the module 30 so as to fully protect it from a high temperature condition generated at either end of the control unit 16 (see FIG. 1). Further, the use of an open-nose switch permits a very fast switch response time to a sensed over-temperature condition.

Figure 4:
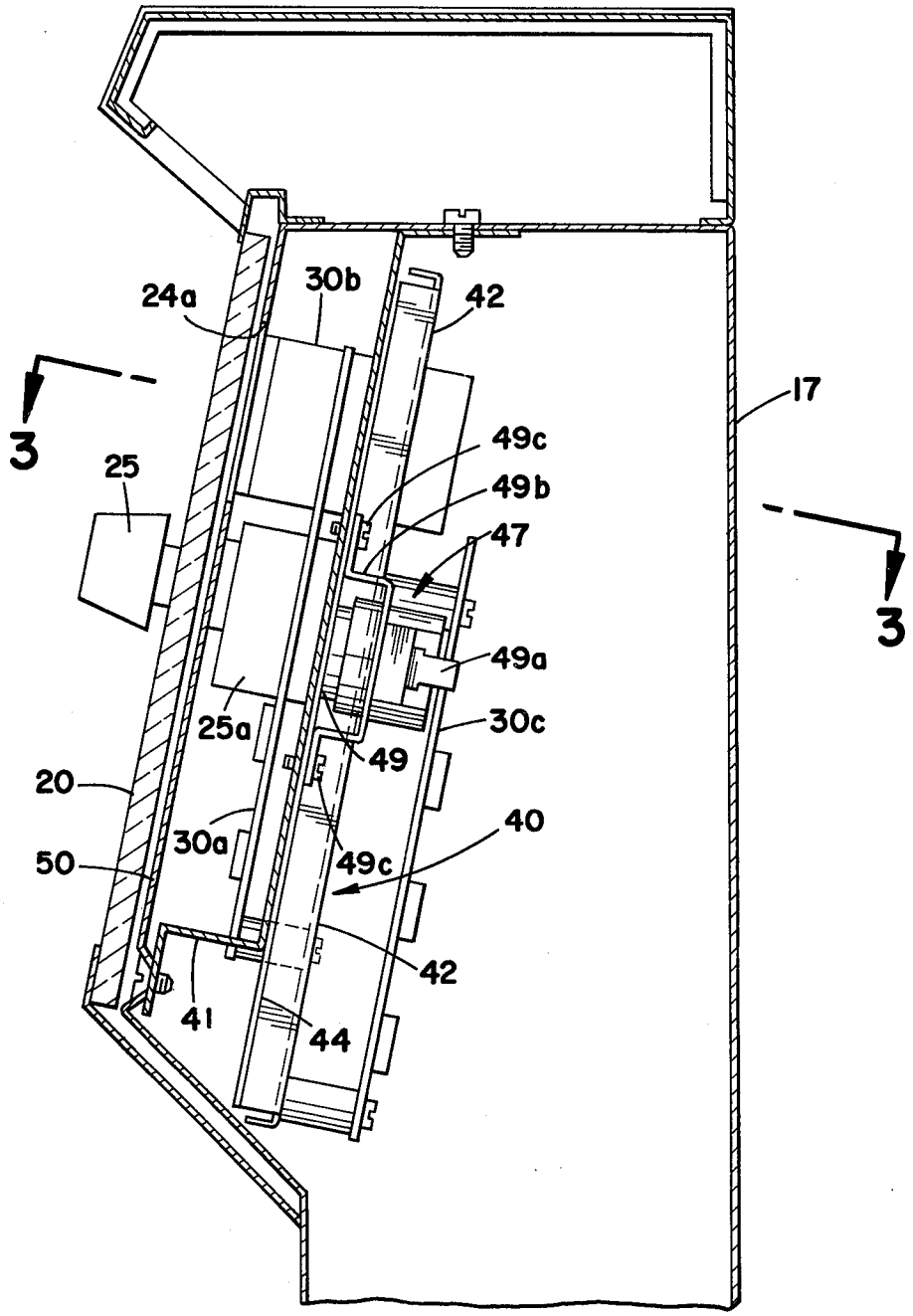
FIG. 4 is a side view cross section of the control unit illustrated in FIG. 2, taken along line 4—4 of FIG. 2.

With reference to FIG. 4, the bimetallic snap disc switch 47 (which is identical to the snap disc switch 48) is further illustrated as including, in addition to the nose portion 49, a mounting bracket 49*b* which secures, by appropriae screws 49*c*, the switch 47 in position against the heat sink flange 44. A pair of contacts 49*a* (only one shown) has connected between them a single pole switch which is in a normally closed position until a high temperature condition is reached wherein a bimetallic snap disc in the nose portion 49 actuates the switch to an open condition in a well known manner.

Figure 5:
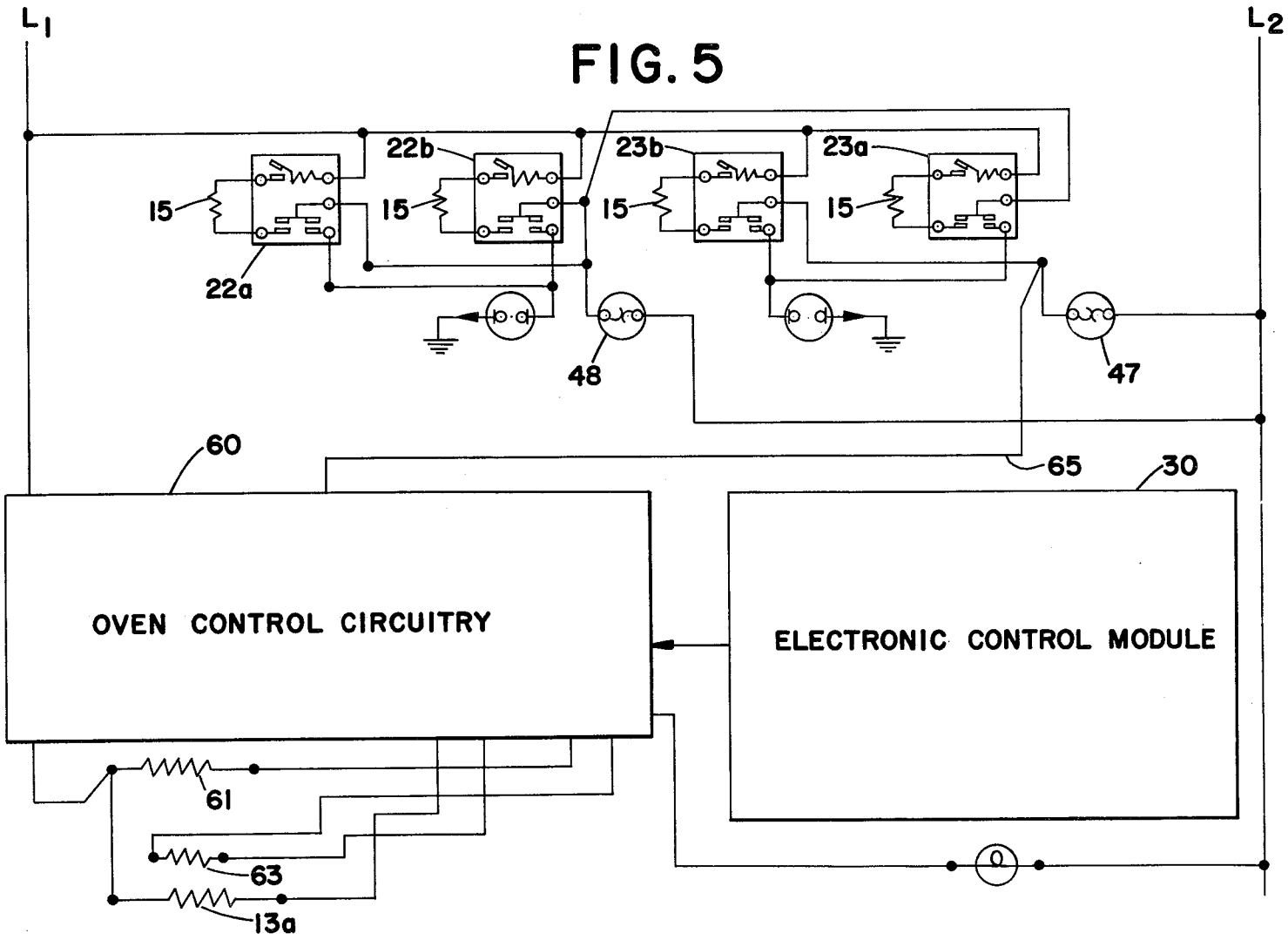
FIG. 5 is a schematic diagram of a typical range control circuit in accordance with the present invention.

Turning to FIG. 5, there is illustrated in schematic fashion a typical control circuit for a domestic range of the type illustrated in FIGS. 1 through 4. The electric power control elements 22*a*, 22*b*, 23*a*, 23*b* for the surface heating elements 15 are schematically illustrated as being energized by a pair of power lines $L_1$, $L_2$ in a typical fashion. Power to the elements 15 energized via control elements 22*a*, 22*b*, and 23*a* is provided via the snap disc switch 48. The snap disc switch 47 provides power to control element 23*b* as well as to the oven control circuitry 60 via a power control line 65. The oven control circuitry 60 is of a conventional nature and energizes, in a known fashion, the oven heating elements 13*a* along with, for example, a broil element 63 and its associated speed broil element 61. It can be seen that opening of the thermostatic switches 47, 48 will disable the powering of the respective portions of the heating elements contolled so as to preclude overheating of the control module 30 as discussed above.

While the present invention has been illustrated in the environment of a domestic range of the electric resistance heating type, it is to be understood that the invention has equal applicability to a gas range wherein over-temperature protection of an electronic control module of the type illustrated is desired. Also as noted earlier, the present invention applies to a fully electronically controlled range, although FIGS. 1 through 4 illustrate the range having conventional knob-type mechanical controls for the heating elements, both of the surface heating type and the oven heating type.

The switches 47, 48 in conjunction with the heat sink 40 advantageously preclude overheating of the associated control module 30. The switches 47, 48 are relatively low in cost and easily handle high current loads over many switch cycles. The relative simplicity of the heat sink in combination with the switches 47, 48 provides a very rugged and reliable over-temperature protection means for the electronic control module 30.

Although the preferred embodiment of this invention has been shown and described, it should be understood that various modifications and rearrangements of the parts may be resorted to without departing from the scope of the invention as disclosed and claimed herein.

What is claimed is:

1. In a domestic range having a radiant-type heating means temperature-regulated by a control unit including an electronic control module, an over-temperature protection means for the control module comprising:

a temperature-sensitive switch means located generally at the site of the control module, the switch means disabling at least a portion of the heating means at a predetermined sensed temperature to preclude damage to the module caused by high temperatures generated by the heating means; and a metallic heat sink member, both the switch means and the module being fixed thereto, the switch means sensing the temperature of the heat sink member portion to which it is fixed.

2. In a domestic range of the electric type having a plurality of resistance wire heating elements of the radiant-type that are temperature-regulated by a control unit including an electronic control module, an over-temperature protection means for the control module comprising:

a normally closed temperature-sensitive electrical switch means-connected in electrical series relationship between at least one of the heating elements and its electrical power source, the switch means being located generally at the site of the control module to terminate the application of electrical power to the heating element at a predetermined sensed temperature wherein heating of the module by the heating elements is limited, the switch means includes a pair of bimetallic snap disc switches, one switch being in electrical series relationship with a portion of the heating elements, the other switch being in electrical series relationship with the remaining portion of the heating elements, the switches each being located at an opposed side of the module in adjacent spaced relationship thereto, the module being straddled by the switches, the switches and the module being fixed to a common heat sink member, the switches sensing the temperature of the heat sink member portions to which they are fixed.

3. An apparatus according to claim 2, wherein the heat sink is enclosed inside the control unit, the control unit being boxlike and having a front exterior glass panel exposed to radiant heat from at least one of the radiant-type heating elements, the heat sink being spaced from the front panel, the front panel being generally opaque through a major portion of its extent.

4. In a freestanding domestic range of the electric type having a horizontal cooking platform providing a plurality of pancake-shaped surface heating elements of the radiant-type formed of spirally wound resistance wire, an elongated boxlike control unit extending upwardly from and across the back edge of the cooking platform, the control unit regulating the temperature of the surface heating elements, an oven chamber of the pyrolytic self-cleaning type being located below the cooking platform and including radiant type heating elements formed of resistance wire also temperature-regulated by the control unit, an over-temperature protection means for protecting an electronic module located inside of the boxlike control unit, comprising:

a heat sink constituted by a metal platelike member enclosed by the control unit and spaced from the exterior walls of the control unit, the electronic module being fixed to and generally centered on the heat sink; and a pair of bimetallic snap disc-actuated electrical switches fixed to the heat sink member, the switches straddling the module and being spaced from it, the switches being equidistantly spaced above the horizontal cooking platform, the switches being normally closed at and below a predetermined sensed temperature, one switch being in electrical series relationship with a portion of the heating elements, the other switch being in electrical series relationship with a remaining portion of the heating elements, the switches independently cycling their respective heating element portions on and off to maintain the control module below a predetermined temperature caused primarily by heat generated by the heating elements.

* * * * *